US005164528A

United States Patent [19]

Arai et al.

[11] Patent Number: 5,164,528

[45] Date of Patent: Nov. 17, 1992

[54] KEYBOARD APPARATUS FOR MUSICAL INSTRUMENT

[75] Inventors: Yoneaki Arai, Tokorozawa; Hirokazu Taniguchi, Fussa; Daisuke Okizawa, Tokyo, all of Japan

[73] Assignee: Casio Computer Co., Ltd., Tokyo, Japan

[21] Appl. No.: 606,088

[22] Filed: Oct. 30, 1990

[30] Foreign Application Priority Data

Dec. 27, 1989 [JP] Japan ..... 1-336687
Dec. 30, 1989 [JP] Japan ..... 1-151126[U]
Dec. 30, 1989 [JP] Japan ..... 1-341512

[51] Int. Cl.[5] ..... G10C 3/02

[52] U.S. Cl. ..... 84/177; 84/DIG. 17; 84/DIG. 3

[58] Field of Search ..... 84/177, 178, 424, 430, 84/179, DIG. 17, 423 R, 423 A, 423 B, 608–614, 718, 719, 744, DIG. 3

[56] References Cited

U.S. PATENT DOCUMENTS 3,205,754 9/1965 Becwar ..... 84/423 R
3,797,357 3/1974 Thomas et al. ..... 84/423 R
4,091,707 5/1978 Martin et al. ..... 84/423 R
4,413,545 11/1983 Okamoto et al. ..... 84/609
4,614,144 9/1986 Sagara et al. ..... 84/609
4,619,175 10/1986 Matsuzaki ..... 84/718
4,635,521 1/1987 Bellini ..... 84/177
4,914,999 4/1990 Masubuchi et al. ..... 84/423 R

FOREIGN PATENT DOCUMENTS 64-91186 4/1989 Japan .
64-91187 4/1989 Japan .
1101154 8/1965 United Kingdom .

*Primary Examiner*—Michael L. Gellner
*Assistant Examiner*—Cassandra C. Spyrou
*Attorney, Agent, or Firm*—Frishauf, Holtz, Goodman & Woodward

[57] ABSTRACT

This invention relates to a keyboard apparatus for a musical instrument such as a musical keyboard instrument for electronic pianos, electronic organs, or acoustic keyboards. This keyboard apparatus has a musical instrument body, a plurality of keys attached to the musical instrument body, and a console panel attached to the musical instrument body. A key concealing unit for concealing the base end portions of the plurality of keys are integrally molded with one edge of the console panel.

5 Claims, 15 Drawing Sheets

KEYBOARD APPARATUS FOR MUSICAL INSTRUMENT

BACKGROUND OF THE INVENTION

1. Field of the Invention

The present invention relates to a keyboard apparatus for an electronic musical keyboard instrument such as an electronic piano or an electronic organ.

2. Description of the Related Art

In electronic musical keyboard instruments such as electronic pianos, electronic organs, or electronic synthesizers, a plurality of keys constructed by white and black keys are provided on a musical instrument body (hereinafter referred to as "a musical instrument case") in accordance with a predetermined arrangement. The keys are installed in the musical instrument case such that each key is rotated around each base end portion thereof as a rotary fulcrum in a vertical direction.

There are a plurality of methods of installing keys in the musical instrument case in such electronic musical keyboard instruments. In a first installing method, the base end portion of each key is attached directly from an upper surface side on the musical instrument case with which a front panel is integrally molded. In a second installing method, the base end portion of each key is firstly attached to a keyboard chassis as another component. Then, this keyboard chassis is attached from a lower surface side in the musical instrument case with which a front panel is integrally molded to expose the keys on the musical instrument case.

In the former first installing method, the base end portions of the keys can be attached from the front surface side of the musical instrument case on the musical instrument case. Accordingly, the installing work is simple and ready. However, since the attaching structure of the base end portions of the keys are exposed out of the musical instrument case, its external appearance is defective. Therefore, this musical instrument particularly needs a concealing member for concealing the attaching structure of the base end portions of the keys. The concealing member increases the number of components of the keyboard apparatus and hence a cost increases.

In the latter second installing method, the attaching structure of the base end portions of keys is disposed in the musical instrument case. Accordingly, the attaching structure is not exposed out of the musical instrument case. However, a work for attaching the keyboard chassis as another component from the rear surface side in the musical instrument case causes the troublesome assembly of the keyboard apparatus. The keyboard chassis increases in number of components of the keyboard apparatus and hence a cost increases.

A keyboard apparatus having a plurality of keys integrally molded of synthetic resin which each other is disclosed, for example in Published unexamined Japanese Patent Application Nos. 64-91186 and 64-91187, U.S. Pat. Nos. 3,205,754 and 3,797,357. In this keyboard apparatus, the numbers of components directly relative to a plurality of keys and assembling steps can be reduced to certain degree, but a reduction in the numbers of the components and the assembling steps of an entire keyboard apparatus is insufficient.

SUMMARY OF THE INVENTION

This invention is contrived from the above described situation, and an object of the present invention is to provide a keyboard apparatus in which an attaching structure of base end portions of keys to a musical instrument body is not exposed out of the musical instrument body.

Another object of the present invention is to provide a keyboard apparatus in which reduction in the number of components and assembling workability are sufficiently improved.

In order to achieve the above described objects of the present invention, a keyboard apparatus according to the present invention comprises: a musical instrument body; a plurality of keys detachably attached at the base end portions thereof to the musical instrument body; and a console panel attached to said musical instrument body to cover the base end portions of said keys attached to said musical instrument body; one side edge of said console panel being integrally molded with a key concealing portion for concealing the base end portions of said keys attached to said musical instrument body.

In one constructional example of the present invention, the base end portions of a plurality of keys are attached on the musical instrument body, and, then, the console panel with which a key concealing portion is integrally molded is attached on the musical instrument body. The console panel can be attached directly on the musical instrument body from the upper surface side, so that the key concealing portion conceals the base end portions. Therefore, the assembling work of the keyboard apparatus can be simply and rapidly performed. The key concealing portion integrally molded with the console panel conceals the attaching structure of the base end portions of the keys simultaneously upon attaching the panel on the musical instrument body to prevent the attaching structure from exposing out of the musical instrument body. Therefore, the external appearance of the keyboard apparatus is improved. The key concealing portion integrally molded with the console panel reduces in the number of components of the keyboard apparatus.

In another constructional example of the present invention, a console panel, integrally molded with a key concealing portion which is used for concealing the attaching structure of the base end portions of a plurality of keys and a speaker attached portion on which a speaker is to be attached, is attached on a musical instrument body. Therefore, the key concealing member formed separately is not particularly necessary, and a speaker can be attached simultaneously on the speaker attaching portion when various types of switches are attached on the console panel. Accordingly, the speaker attaching work can be simply and rapidly performed.

In a further constructional example of the present invention, a console panel integrally molded with a key concealing portion which is used for concealing the attaching structure of the base end portions of a plurality of keys and a musical sound card containing portion for containing a musical sound card, is attached on a musical instrument body. Therefore, a key concealing member formed separately is not particularly required. Electronic parts such as connectors can be attached simultaneously to the musical sound card containing portion when various types of switches are attached on the console panel. Accordingly, the attaching work of electronic parts such as connectors to the console panel can be simply and rapidly performed.

In still another constructional example of the present invention, a console panel, integrally molded with a key concealing portion for concealing the attaching portion of the base end portions of a plurality of keys, a musical sound card containing portion for containing a musical sound card, and a speaker attaching portion on which a speaker is to be attached, is attached on a musical instrument body. Therefore, the key concealing member formed separately is not particularly required. Accordingly, Electronic parts such as connectors can be simply and rapidly attached to the musical sound card containing portion and a speaker can be simply and rapidly attached on the speaker attaching portion when various types of switches are attached on the console panel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and together with the general description given above and the detailed description of the preferred embodiments given below, serve to explain the principles of the invention.

DETAILED DESCRIPTION OF THE PREFERRED EMBODIMENTS

Various embodiments and modifications of the present invention will be described in detail with reference to the accompanying drawings.

Figure 1:
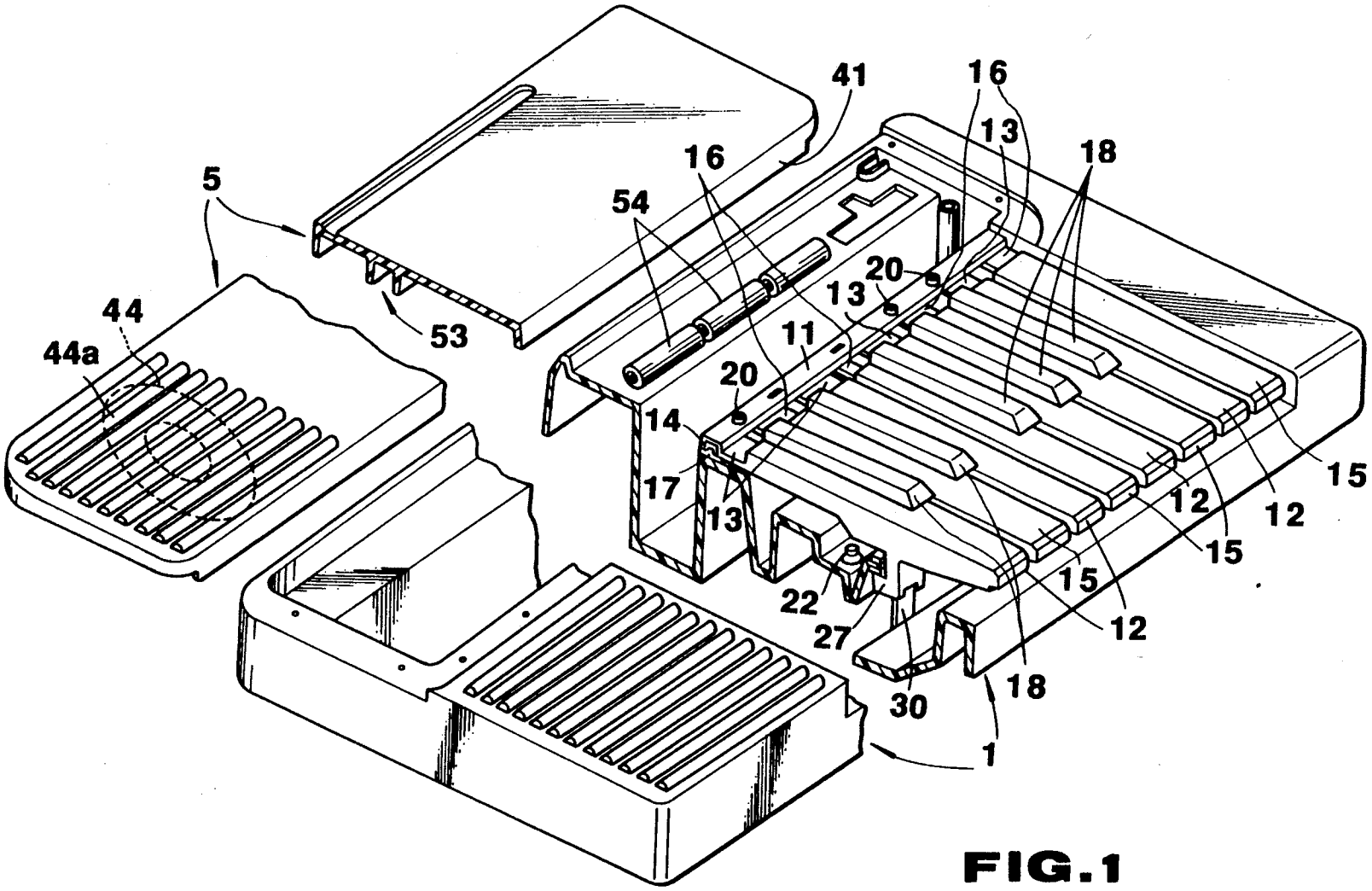
FIG. 1 is an exploded perspective view showing a main portion of an electronic musical keyboard instrument according to a first embodiment of the present invention.
Figure 2:
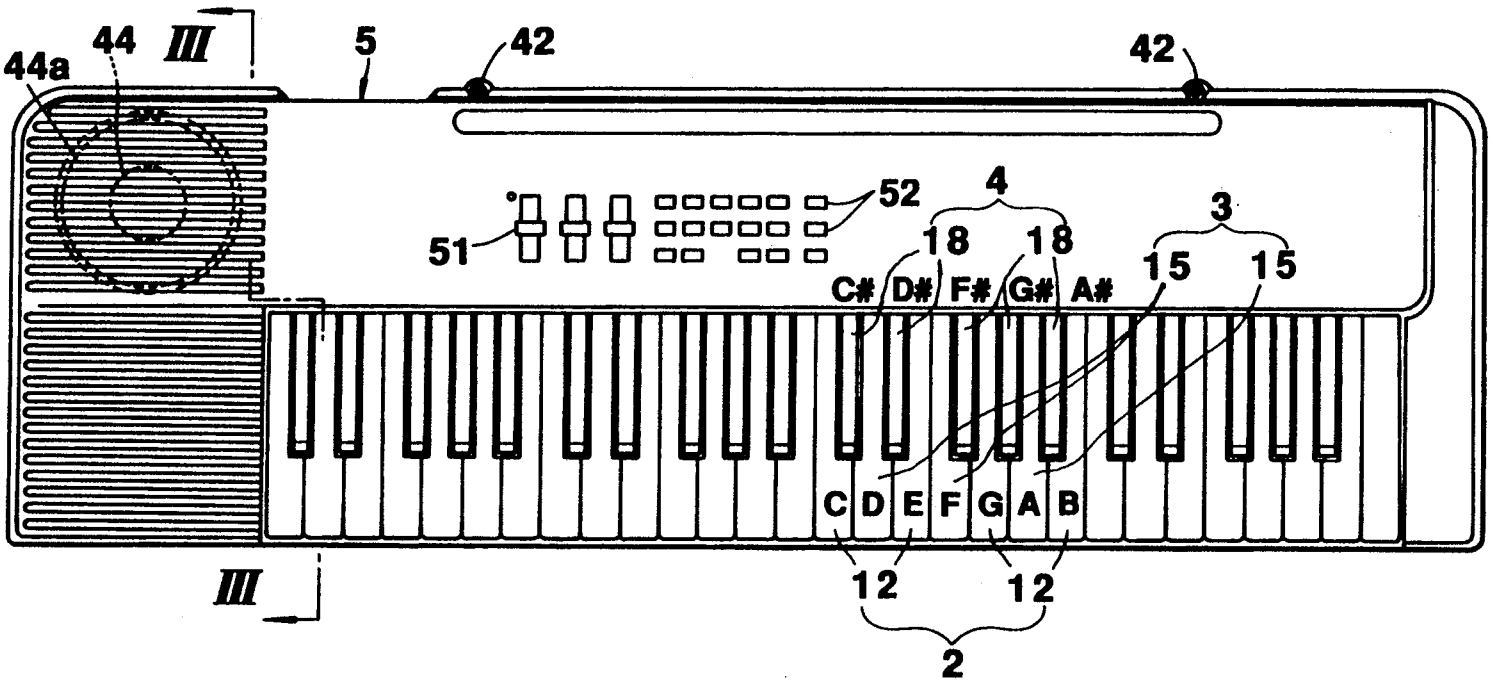
FIG. 2 is a plan view showing the electronic musical keyboard instrument of FIG. 1.
Figure 3:
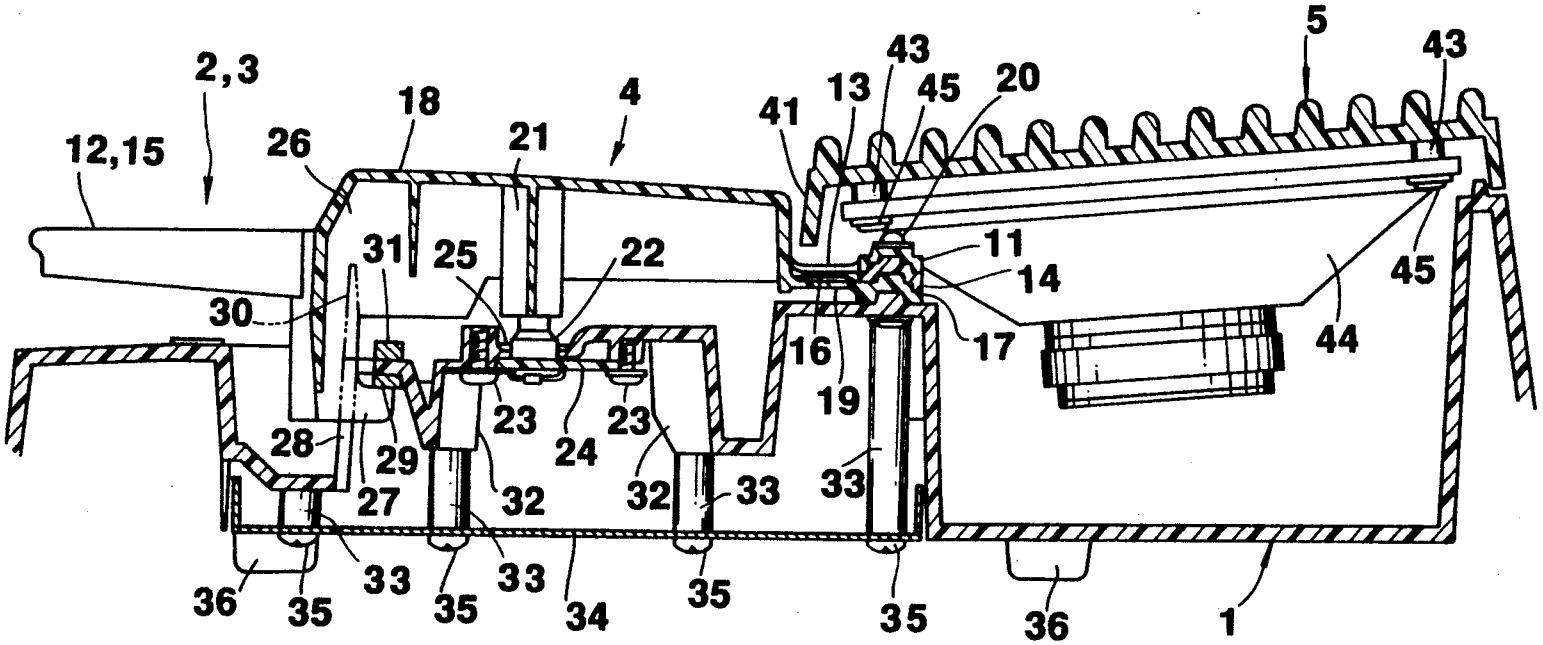
FIG. 3 is a sectional view taken along the lines III—III of FIG. 2.

FIGS. 1 to 3 schematically show a main portion of a first embodiment of an electronic musical keyboard instrument according to the present invention.

As shown in FIGS. 1 and 2, in this electronic musical keyboard instrument, a plurality of white key groups 2, 3, which are classified into two types and made of synthetic resin, and a plurality of black key groups 4, which are consisted of only one type and made of synthetic resin, are disposed in predetermined arrays on the front half of the upper surface of a musical instrument case 1 and a console panel 5 made of synthetic resin is disposed on the rear half of the upper surface of the musical instrument case 1. The musical instrument case 1 is made of synthetic resin and constructs a musical instrument body.

Each white key group 2 of one type has four white keys 12 for designating pitches of C, E, G and B. These four white keys 12 are integrally molded with a common mounting plate 11 (FIG. 1) so as to connect with the mounting plate 11 through thin flexible portions 13. Gap corresponding to the width of one white key is created between adjacent two ones among the four white keys 12. Each white key group 3 of the other type has three or four white keys 15 for designating pitches of D, F and A or D, F, A and C. These three or four white keys 15 are integrally molded with a common mounting plate 14 having the same length as that of the mounting plate 11 of one type white key group 2, and are connected with the mounting plate 14 through thin flexible portions 16. Gap corresponding to the width of one white key is created between adjacent two ones among the three or four white keys 15. Each black key group 4 has five black keys 18 for designating pitches of C#, D#, F#, G# and A#. These five black keys 15 are integrally molded with a common mounting plate 17 having the same length as that of the mounting plate 11 of one type white key group 2, and are connected with the mounting plate 17 through thin flexible portions 19 (FIG. 3).

When the key groups 2 to 4 described above are disposed at predetermined positions of the musical instrument case 1, the common mounting plate 17 of each black key group 4 is placed at a predetermined position on the upper surface of the musical instrument case 1. Then, the common mounting plate 14 of each of the other type white key groups 3 is superposed at a predetermined position on the upper surface of the common mounting plate 17 of the black key group 4, and the common mounting plate 11 of each of the above described one type white key group 2 is superposed at a predetermined position on the upper surface of the common mounting plate 14 of each of the other type white key groups 3. The white keys 12, 15 and the black keys 18 for one octave are disposed at predetermined arrays in the state that the three mounting plates 17, 14 and 11 are superposed as described above, and screw insertion holes (not shown) formed at the mounting plates 11, 14 and 17 coincide with each other. When screws 20 are inserted into the screw insertion holes coincident with each other and are screwed into the threaded holes (not shown) formed at the musical instrument case 1, the white key groups 2, 3 and the black key group 4 for one octave are attached to the musical instrument case 1. It is noted that the black key group 4 may be provided for two octaves instead of one octave. In this case, two common mounting units 11 of two white key groups 2 of one type each of which is for one octave are provided on the common mounting unit 18 of the black key group 4 for two octaves, and the two common mounting plates 14 are superposed on two white key groups 3 of the other type each of which is for one octave.

The keys of each key groups 2, 3 and 4 will be described with the black keys 18 as a representative, and the descriptions of the white keys 12, 15 will be omitted.

As shown in FIG. 3, a switch pressing projection 21 having a cross-shaped cross section is formed at the center on the lower surface of each black key 18. A pushbutton self-reset type rubber switch (hereinafter referred to as "a rubber switch") 22 is disposed under the switch pressing projection 21. The rubber switch 22 is provided on a circuit board 24, attached on the inner surface of the musical instrument case 1 with screws 23, to project out from the upper surface of the musical instrument case 1 through a through hole 25 formed in the musical instrument case 1. The black key 18 is urged upwardly by the elastic returning force of the flexible portion 19 of the base end thereof and the self-resetting force of the rubber switch 22. The maximum upwardly moving position (initial position before the key is depressed) of the black key 18 is defined by bringing an L-shaped hook 27, formed on the front lower end of a side plate 26 of the black key 18 to project downwardly and inserted into a through hole 28 formed at the musical instrument case, into contact with a strip-shaped upper limit stop 29 made of such as a felt or the like and provided on the inner surface of the musical instrument case 1 at a position adjacent to the through hole 28. A strip-shaped lower limit stop 31 made of such as a felt or the like is mounted on the upper surface of the musical instrument case 1 at a position corresponding to the upper limit stop 29, to which the lower end of the side plate 26 of the black key 18 contacts when the black key 18 is rotated downwardly with it being guided by a key guide 30 from the above-mentioned initial position. The lower limit stop 31 defines the maximum downwardly moving position of the black key 18. Reinforcing ribs 32 and posts 33 with threaded holes are formed to project downwardly at a region on the inner surface of the musical instrument case 1, located around the circuit board 24, and a rear cover 34 made of a metal plate is attached to the projecting end of the post 33 by means of screws 35. Legs 36 are integrally molded with the musical instrument case 1 at a plurality of positions on the lower surface of the musical instrument case 1.

Now the console panel 5 will be described in detail in the followings.

As shown in FIGS. 1 and 2, the console panel 5 has a key concealing portion 41 on the entire area of the front end, and two recesses 42 for a musical sheet stand (not shown) at the rear end. The console panel 5 further has speaker mounting posts 43, as shown in FIG. 3, with threaded holes at a plurality of positions on the left end portion in FIG. 1, and a speaker 44 is attached on the speaker mounting post 43 by means of screws 45. A sound hole **44*a* for allowing a sound generated from the speaker 44 to spread out is formed at a part of the console panel 5 opposing to the speaker 44**.

When the console panel 5 is installed in the musical instrument case 1, screws (not shown) are screwed into the console panel 5 from the rear surface side of the musical instrument case 1 so that the key concealing unit 41 is disposed above the stacked mounting plates 11, 14 and 17 of the key groups 2, 3 and 4, as shown in FIG. 3.

As shown in FIG. 2, slide knobs 51 of a plurality of slide switches and switch buttons 52 of a number of pushbutton switches are disposed in predetermined arrays on the upper surface of the console panel 5. These slide and pushbutton switches are electrically connected to a main circuit board (not shown) attached to projecting end surfaces of downwardly projecting supporting posts with threaded holes formed on the inner surface of the console panel 5. The circuit board 24 to which the rubber switches 22 are attached is also electrically connected to the main circuit board. The main circuit board is supplied with electric current from a plurality of dry cells 54 contained in a dry cell containing portion 53 formed by sidewalls protruding downwardly from the predetermined positions of the inner surface of the console panel 5 so as to be arranged in parallel to each other, as shown in FIG. 1.

According to the electronic musical keyboard instrument of the first embodiment constructed as described above, when the keys 12, 15 and 18 are depressed against the elastic force of the flexible portions 13, 16, and 19 and the elastic forces of the rubber switches 22, the switch pressing projections 21 press the corresponding rubber switches 22, the depressed rubber switch 22 is elastically deformed to be turned on, and the main circuit board described above (not shown) generates a musical tone preset to correspond to the depressed rubber switch 22 from the speaker 44. When the depressing force applied to the depressed keys 12, 15 and 18 is released, the keys 12, 15 and 18 are returned to their initial positions by the elastic returning force of the flexible portions 13, 15 and 19 and the elastic resetting forces of the rubber switches 22, and the rubber switches 22 are simultaneously released from the elastic deformation to be turned off.

In the electronic musical keyboard instrument, the mounting plates 11, 14 and 17 of the key groups 2, 3 and 4 can be attached directly on the musical instrument case 1 from the upper surface side thereof, and one octave of a keyboard is composed of the three key groups or two octaves of a keyboard is composed of five key groups. Therefore, the installing work of the keys in the musical instrument case 1 can be simply and easily performed. By attaching the console panel 5 on the musical instrument case 1, the key concealing portion 41 of the console panel 5 is disposed above the flexible portions 13, 16 and 19 of the key groups 2, 3 and 4 and the mounting plates 11, 14 and 17 to conceal the flexible portions 13, 16 and 19 and the mounting plates 11, 14 and 17, thereby eliminating the exclusive concealing component formed separately for concealing the flexible portions 13, 16 and 19 and the mounting plates 11, 14 and 17.

Figure 4:
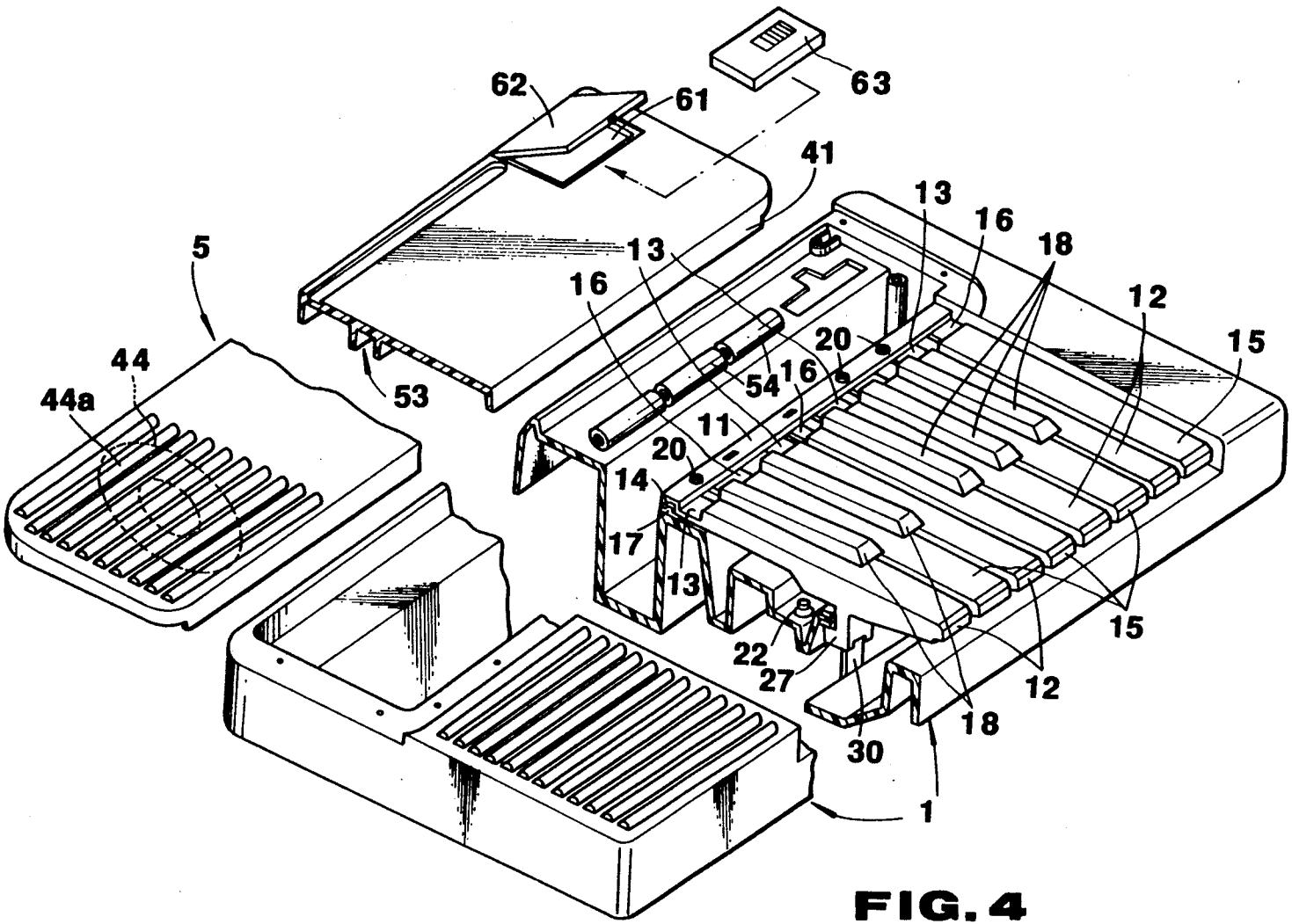
FIG. 4 is an exploded perspective view showing a main portion of an electronic musical keyboard instrument according to a second embodiment of the present invention.
Figure 5:
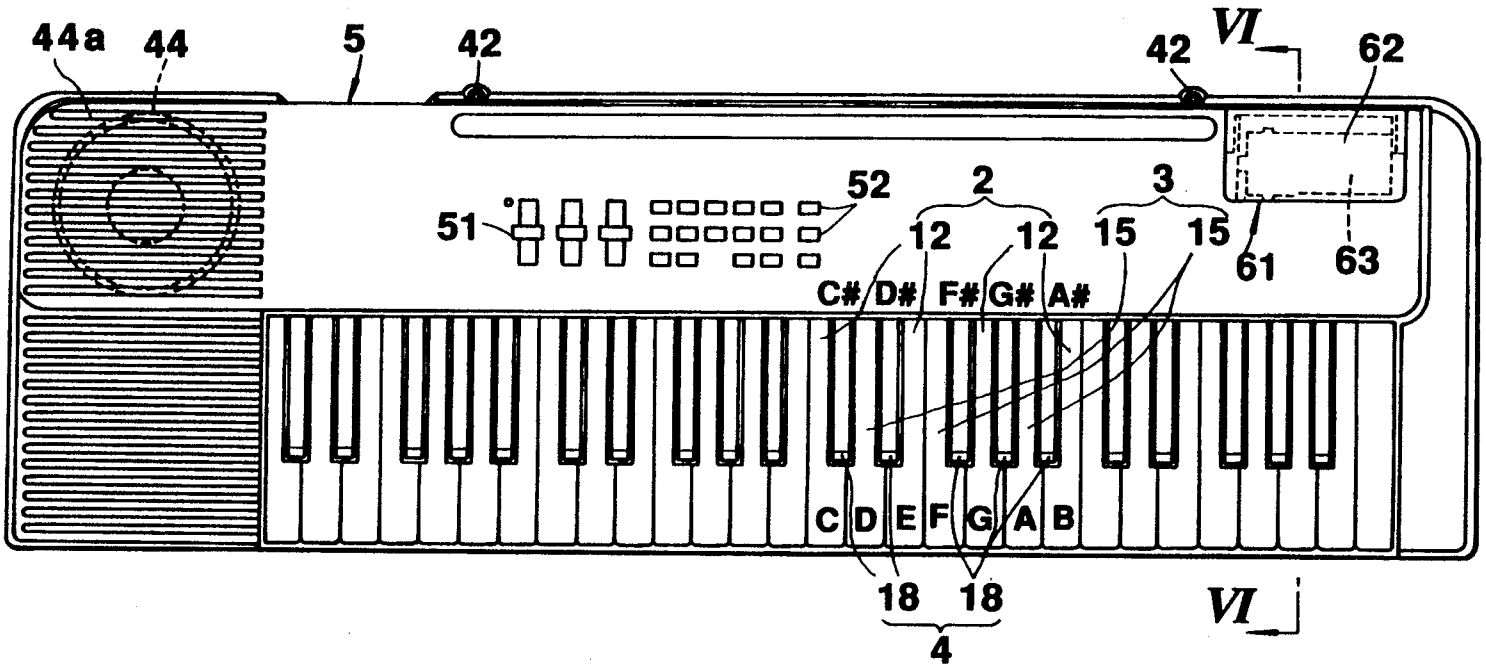
FIG. 5 is a plan view showing the electronic musical keyboard instrument of FIG. 4.
Figure 6:
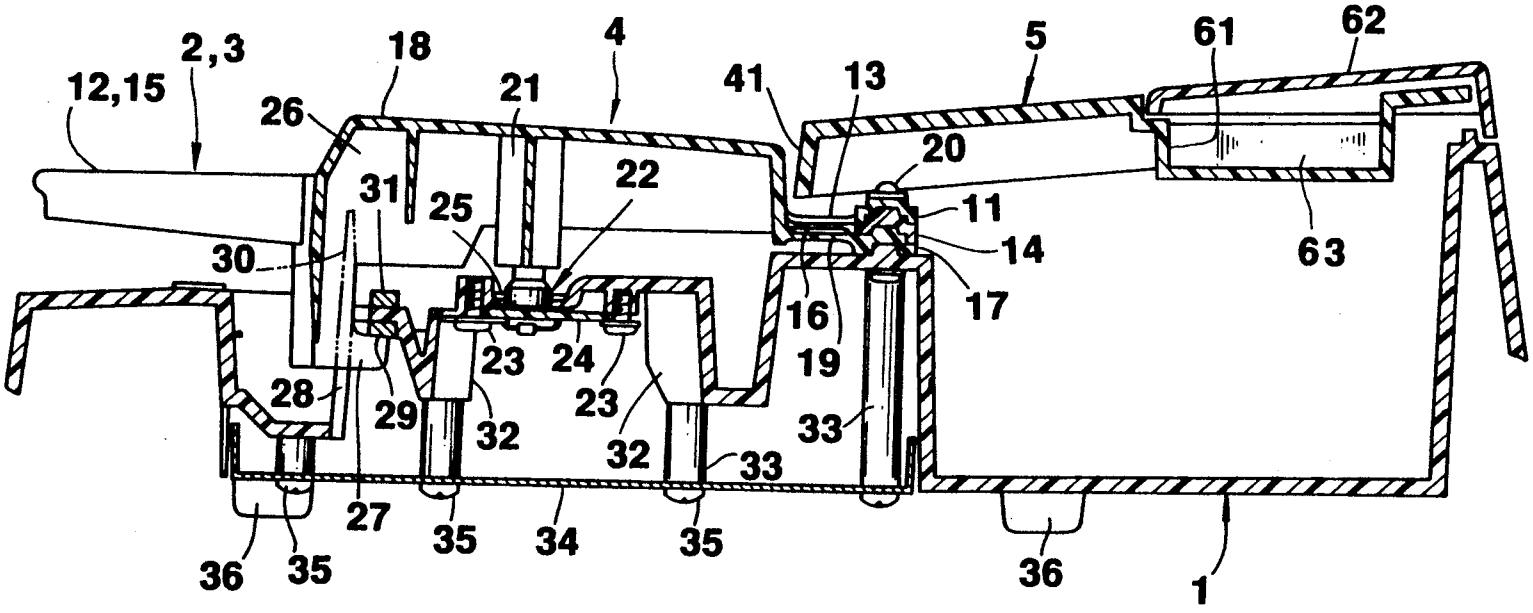
FIG. 6 is a sectional view taken along the line VI—VI of FIG. 5.

FIGS. 4 to 6 show a main portion of an electronic musical keyboard instrument according to a second embodiment of the present invention. In these figures, the same reference numerals as those in the first embodiment shown in FIGS. 1 to 3 are used for designating like or equivalent components in the first embodiment, and the detailed description thereof will be omitted.

In the electronic musical keyboard instrument of this second embodiment, a musical tone card containing portion 61 is integrally molded with a console panel 5 at the right rear end thereof in FIGS. 4 and 5. The musical card containing portion 61 has an opening at the console panel 5, and the opening is covered by an openable cover 62. Musical tone cards 63 in which musical tone information such as melodies, obbligatos, chords, etc. are memorized are detachably contained in the opening.

Figure 7:
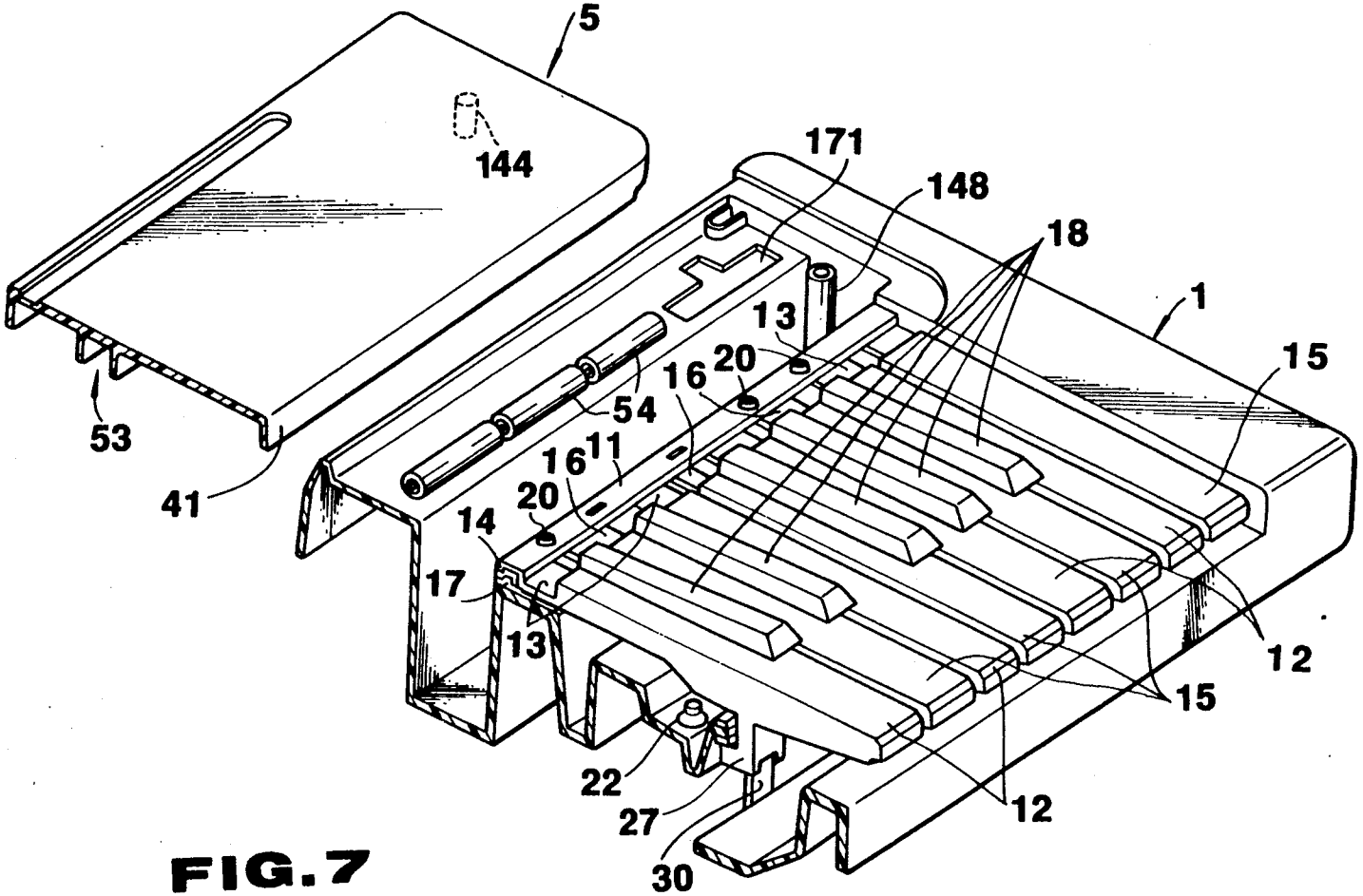
FIG. 7 is an exploded perspective view showing a main portion of an electronic musical keyboard instrument according to a third embodiment of the present invention.
Figure 8:
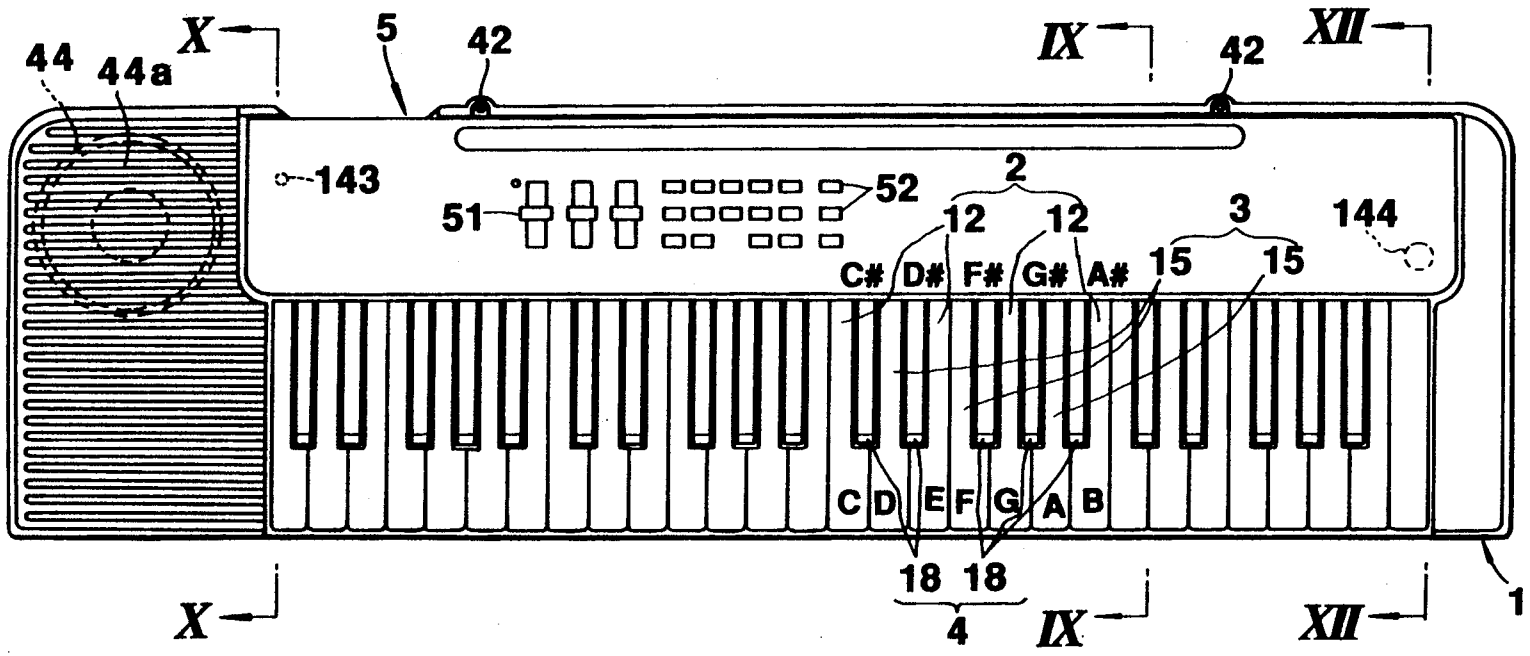
FIG. 8 is a plan view showing the electronic musical keyboard instrument of FIG. 7.
Figure 9:
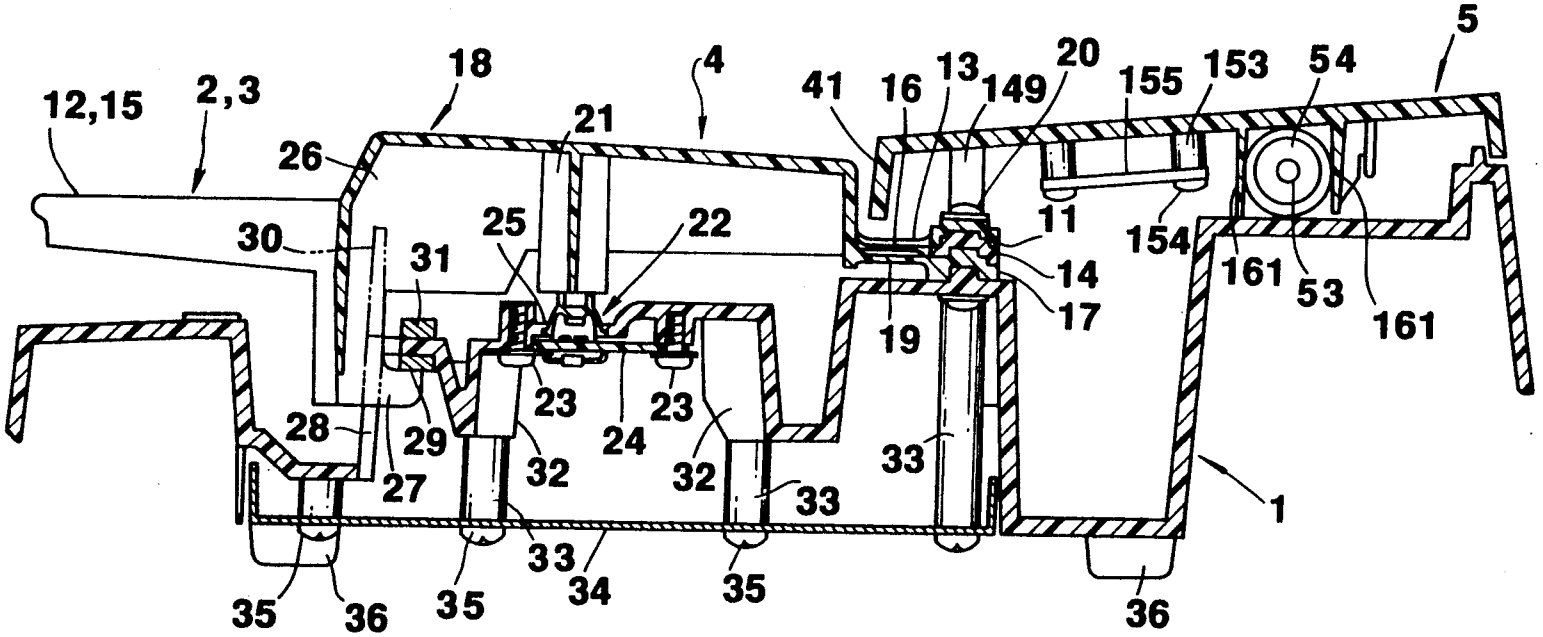
FIG. 9 is a sectional view taken along the lines IX—IX of FIG. 8.

FIGS. 7 to 9 show an electronic musical keyboard instrument according to a third embodiment of the present invention. In these figures, the same reference numerals as those in the first embodiment shown in FIGS. 1 to 3 are used for designating like or equivalent components in the first embodiment, and the detailed description thereof will be omitted.

In order to facilitate the installation of a console panel in a musical instrument case 1 in this third embodiment, a console panel 5 can be temporarily attached on the musical instrument case 1 during the above described installation work.

Figure 10:
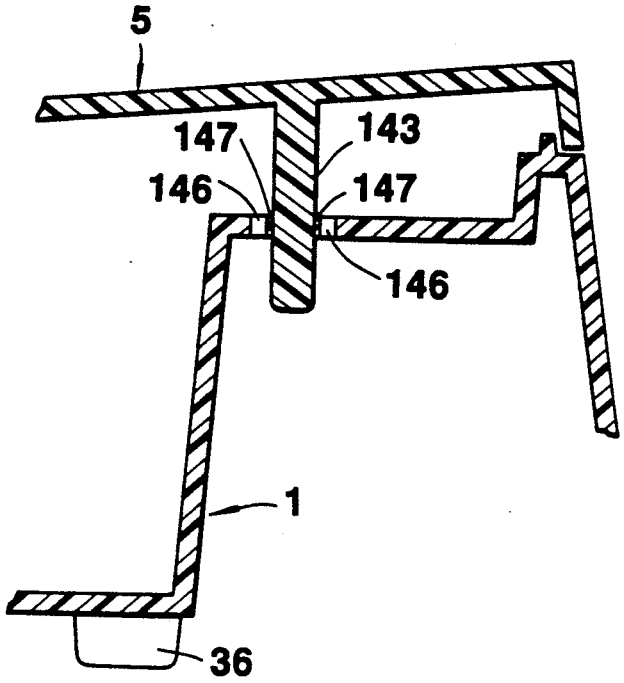
FIG. 10 is a sectional view showing a part of a section taken along the lines X—X of FIG. 8.
Figure 11:
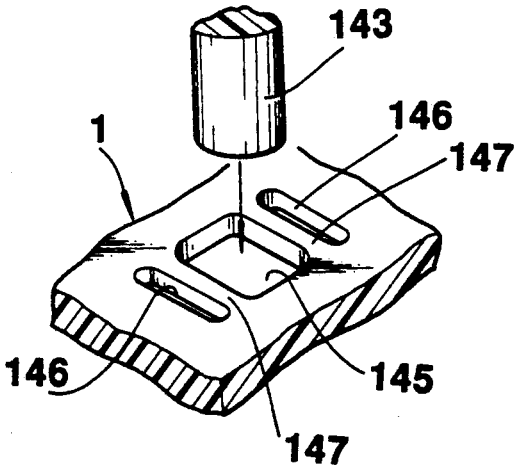
FIG. 11 is an exploded perspective view showing one temporary fixing portion of a console panel of the electronic musical keyboard instrument of FIG. 7.
Figure 12:
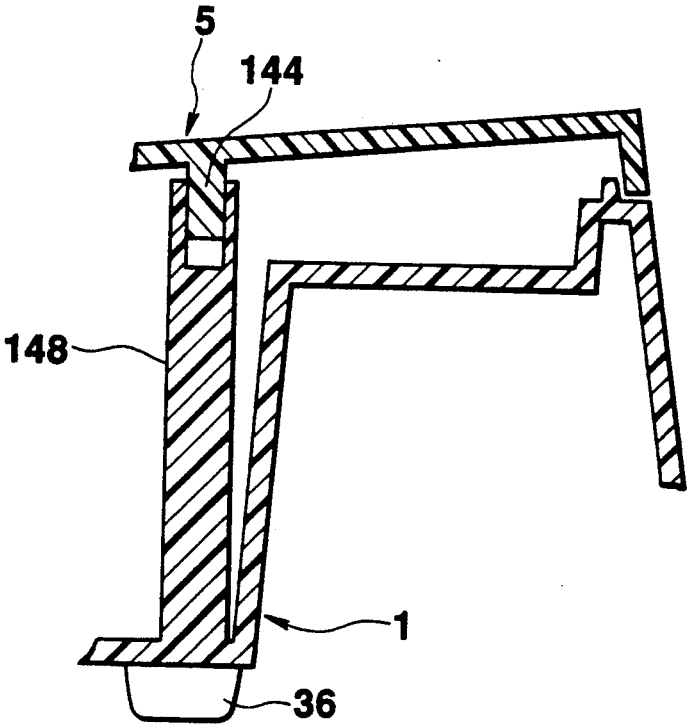
FIG. 12 is a sectional view showing a part of a section taken along the lines XII—XII of FIG. 8.
Figure 13:
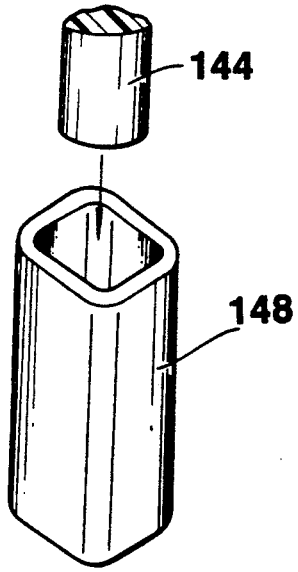
FIG. 13 is an exploded perspective view showing another temporary fixing portion of the console panel of the electronic musical keyboard instrument of FIG. 7.

The console panel 5 in this embodiment has temporarily attaching pins 143 and 144 at two positions in the right and left regions of the inner surface thereof. As shown in FIGS. 10 and 11, a rectangular shaped opening 145 is formed at a position of the musical instrument case 1 corresponding to the left side temporarily attaching pin 143. Slits 146 are formed at the outsides of a pair of short edges of the opening 145, and a pair of bridge portions 147 of the musical instrument case 1 between a pair of short edges of the opening 145 and a pair of slits 146 construct a pair of spring portions. A distance between the pair of short edges of the opening 145 is slightly shorter than the outer diameter of the left side temporarily attaching pin 143. As shown in FIGS. 12 and 13, an upwardly projecting post 148 with a hole is formed at a position of the musical instrument case 1 corresponding to the right side temporarily attaching pin 144. The opening of the projecting end surface of the post 148 has a rectangular shape, and a distance between the pair of short edges of the opening is slightly shorter than the outer diameter of the right side temporarily attaching pin 144.

When the console panel 5 having the above described arrangement is installed in the musical instrument case 1, the left side temporarily attaching pin 143 is press-fitted in the opening 145 against the elastic force of a pair of spring portions 147 and the right side temporarily attaching pin 144 is press-fitted in the opening of the projecting end surface of the post 148 so that a key concealing portion 41 is disposed above the flexible portions 11, 14 and 17 of the key groups 2, 3, and 4.

In this state, even if the musical instrument case 1 is disposed with its rear surface upside, the console panel 5 is not dropped from the musical instrument case 1. A work for screwing screws (not shown), which are used to attach the console panel 5 on the musical instrument case 1, into the rear surface of the turned-out musical instrument case 1 is facilitated. When the console panel 5 is fixed on the musical instrument case 1, the projecting end surface of the wall portion 149 (FIG. 9) formed to project downward at a predetermined position of the inner surface of the console panel 5 is brought into contact with the upper surface of the mounting plate 11 of the while key group 2 disposed upper mostly at the key mounting position on the upper surface of the musical instrument case 1, thereby reinforcing the console panel 5.

FIG. 9 shows a main circuit board 155 on which a plurality of slide switches having slide knobs 51 (FIG. 8) and a number of pushbutton switches having pushbuttons 52 (FIG. 8) are mounted, and these knobs 51 and pushbuttons 52 are projected out from the upper surface of the console pane 5. The main circuit board 155 is fixed at the projecting ends of posts 153 with threaded holes formed to project downward from the inner surface of the console panel 5, and a circuit board 24 on which rubber switches 22 are mounted as already described in the first embodiment is electrically connected to the main circuit board 155. The main circuit board 155 is supplied with electric power from a plurality of dry cells 54 contained in a dry cell containing portion 53 including a pair of sidewalls 161 formed to project downward at predetermined positions on the inner surface of the console panel 5 and to be arranged in parallel to each other.

Figure 14:
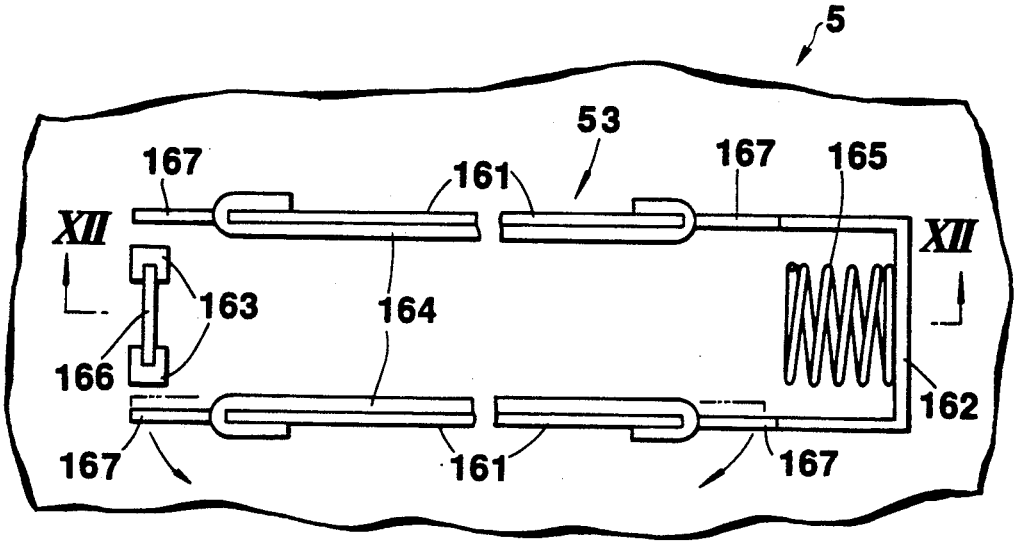
FIG. 14 is a bottom view showing one example of a drycell containing portion provided in the console panel.
Figure 15:
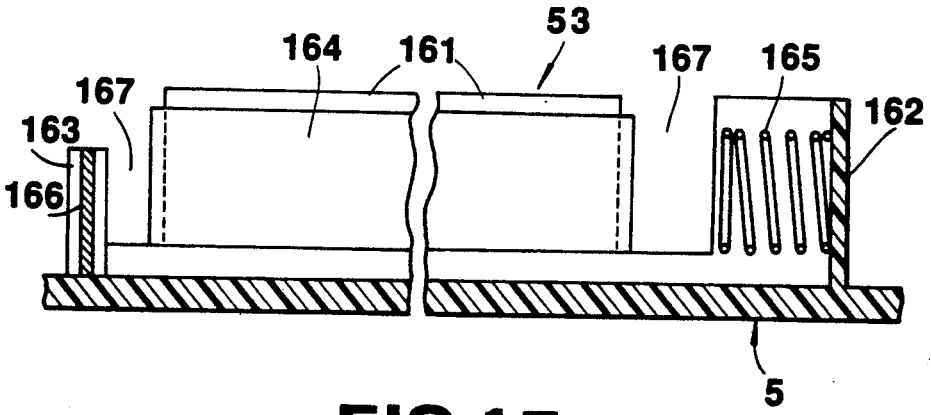
FIG. 15 is a sectional view taken along the lines XV—XV of FIG. 14.

FIGS. 14 and 15 show in detail the dry cell containing portion 53. The dry cell containing portion 53 has an end wall 162 formed on the inner surface of the console panel 5, for blocking one end of the space between a pair of parallel sidewalls 161, and a pair of posts 163 formed on the inner surface of the console panel 5 and disposed in the other end of the space between a pair of sidewalls 161. The pair of posts 163 are spaced from each other in a direction perpendicular to the pair of sidewalls 161, and each of which has a C-shaped cross section. The openings of the cross sections of the posts 53 are opposed to each other. Vibration preventing tapes 164 for preventing a vibration of each dry cell 54 between the pair of sidewalls 161 is adhered to the opposed surfaces of the pair of sidewalls 161. A coil spring 165 is provided on the inner surface of the end wall 162 to be in contact with the negative terminal of the dry cell 54 which is contained between the pair of sidewalls 161 and located adjacent to the end wall 162. A pair of posts 163 support a terminal plate 166 with the both side edges of the plate 166 being held in the openings of the ports 163, and the positive terminal of the dry cell 54 which is contained in the pair of sidewalls 161 and located adjacent to the ports 163.

Cutout portions 167 are formed at both longitudinal ends of each sidewalls 161. When the dry cell 54 to be contained in the dry cell containing portion 53 is, for example, an AA type (in USA) or a TANSAN type (in JAPANESE) dry cell having an outer diameter of 14.5 mm, the distance between the pair of sidewalls 161 is correspondingly small in response to the outer diameter. Therefore, it is difficult to insert a finger between the pair of sidewalls 161, and hence to perform the adhering work of the vibration preventing tapes 164. The cutout portions 167 facilitates the adhering work of the vibration preventing tapes 164. More specifically, one end portion of the vibration preventing tape 164 (e.g., a right end portion in FIG. 14) is brought into contact with the bottom surface of one cutout 167 of the corresponding sidewall 161 so that the position of the vibration preventing tape 16 in heightwise direction is defined, and adhered to the outer surface of one end portion of the sidewall 161. Then, the vibration preventing tape 164 is adhered to the inner surface of the corresponding sidewall 161 in a tensile state, and the other end portion of the vibration preventing tape 164 is bent into the other cutout 167 and adhered to the outer surface of the other end of the corresponding sidewall 161 while bringing the tape 164 into contact with the bottom surface of the other cutout 167. As a result, the vibration preventing tape 164 can be simply and easily adhered at the predetermined height position on the inner surface of the corresponding sidewall 151 with the tape 164 prevented from being wrinkled.

The projecting end surfaces of the pair of sidewalls 161 of the dry cell containing portion 53 are disposed near the upper surface of the musical instrument case 1 when the console panel 5 is installed at a predetermined positions of the musical instrument case 1. When the projecting surface of one or projecting surfaces of both of the pair of sidewalls 161 ar brought into contact with the upper surface of the musical instrument case 1, the console panel 5 can be reinforced. When a dry cell exit 171 is formed at a predetermined position of the musical instrument case 1 corresponding to a cry cell containing space between a pair of sidewalls 161, for example, as shown in FIG. 7, dry cells 54 can be replaced without removing the console panel 5 from the musical instrument case 1. The dry cell exit 171 is closed by a dry cell cover (not shown).

Figure 16:
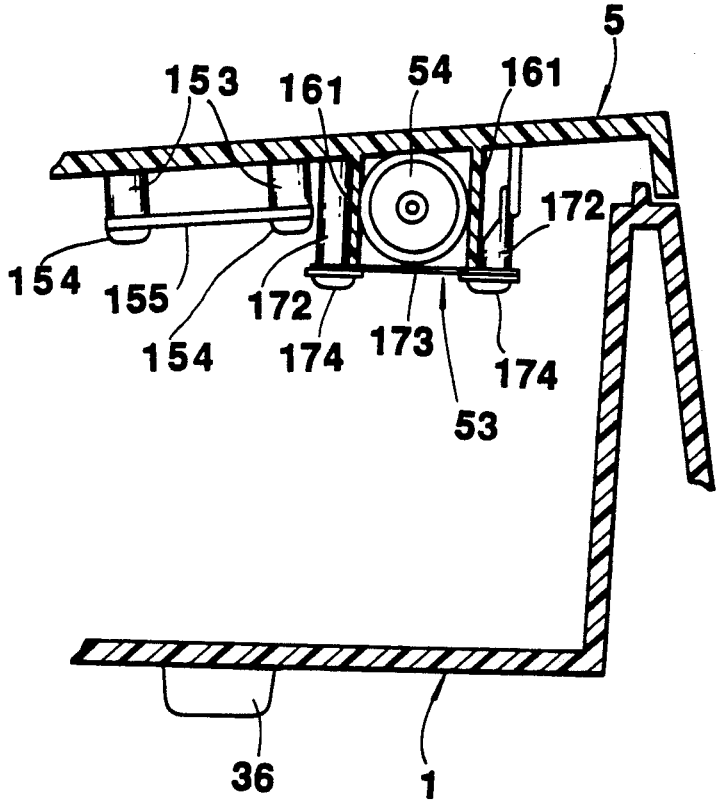
FIG. 16 is a sectional view showing the other example of the dry cell containing portion provided in the console panel.

When the console panel 5 is installed at a predetermined position of the musical instrument case 1, if the projecting end surfaces of the pair of sidewalls 161 are separated from the upper surface of the console case 1, posts 172 with threaded holes are formed to project downward at the outside of the pair of sidewalls 161 on the inner surface of the console panel 5 as shown in FIG. 16, and the dry cell cover 173 is attached at the projecting ends of the posts 172 by means of screws 174 to cover the opening of the dry cell containing chamber at the projecting end side of the pair of sidewalls 161.

Figure 17:
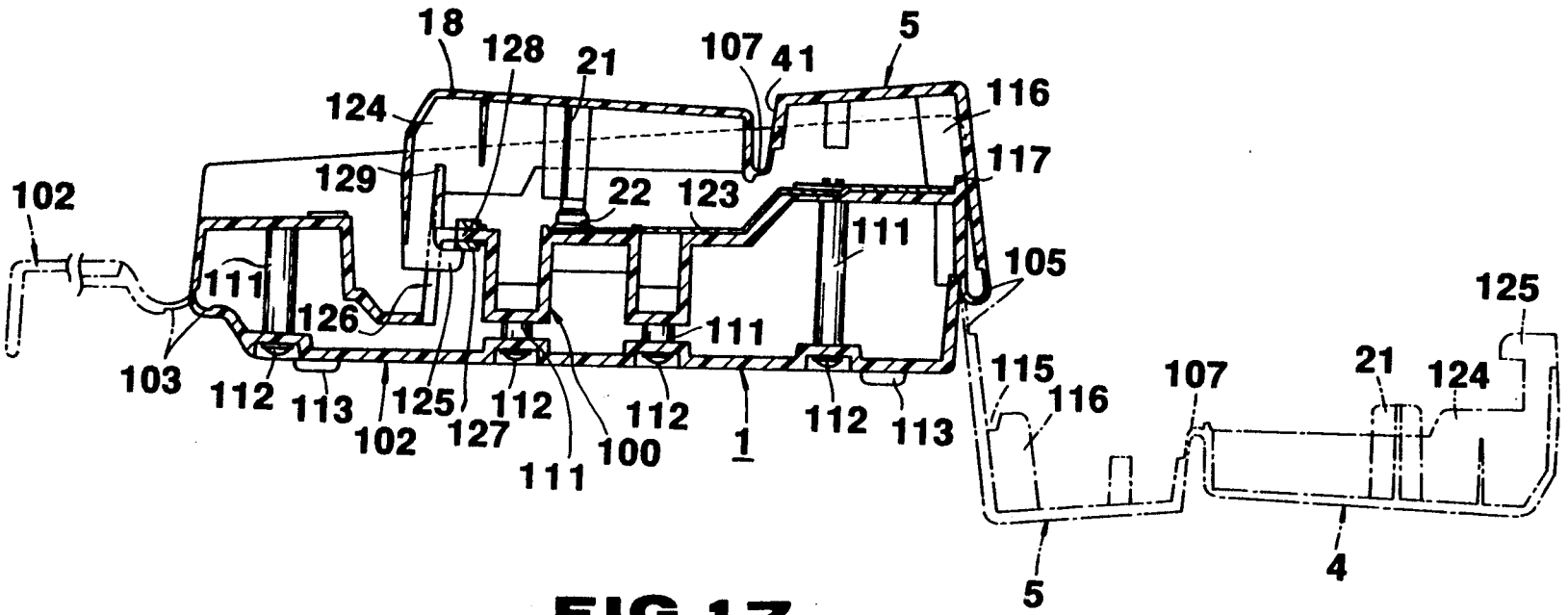
FIG. 17 is a longitudinal sectional view showing a main portion of a keyboard apparatus according to fourth embodiment of the present invention.

FIG. 17 shows a main portion of a keyboard apparatus according to fourth embodiment of the present invention.

In the keyboard apparatus of this embodiment, a lower case 102 is integrally molded with the front end portion of a keyboard chassis 100 of synthetic resin through a thin flexible unit 103, the chassis 100 composing a musical instrument case 1. A console panel 5 is integrally molded with the rear end portion of the keyboard chassis 100 through a thin flexible portion 105. All black keys 18 are integrally molded with the front end portion of the console panel 5 through a thin flexible portion 107.

Posts 111 with threaded holes are formed to project downward at a plurality of positions on the lower surface of the keyboard chassis 100. The lower case 102 is disposed at one side of the keyboard chassis 100 as shown by one-dotted chain line when the integrally molding thereof has been just finished. In the assembling process, at the first time the lower case 102 is moved to the underside of the keyboard chassis 100 as shown by a solid line by elastically deforming the flexible portion 103. The lower chassis 102 is brought into contact with the lower end surfaces of the posts 111 of the keyboard chassis 100, and screws 112 inserted into through holes (not shown) formed at the lower case 102 are screwed into the threaded holes of the lower end surfaces of the posts 111 so that the lower case 102 is fixed to the lower end surfaces of the posts 111. Legs 113 are formed at a plurality of positions on the lower surface of the lower case 102.

Reinforcing ribs 116 are formed at a plurality of positions of the inner rear surface of the console panel 5. A cutout 115 is formed at the base portion of the edge of the each reinforcing rib 116 near the flexible portion 105. A console panel 5 is disposed together with the black keys 18 at one side of the keyboard chassis 100 as shown by one-dotted chain line when the integrally molding thereof has been just finished. In the assembly process, the console panel 5 is moved to the upperside of the rear portion of the keyboard chassis 100 by the elastic deformation of the flexible portion 105, as shown by a solid line, and the cutout 115 of each reinforcing rib 116 is engaged with the engaging wall 117 formed to project upward at the rear end of the upper surface of the keyboard chassis 100, so that the console panel 5 is secured to the rear portion of the keyboard chassis 100. If posts with threaded holes are provided on the inner surface of the console panel 5 or the upper surface of the keyboard chassis 100, screws may be screwed into the threaded holes of the posts through the console panel 5 or the chassis 100 not provided with the posts, thereby fixing the console panel 5 to the rear portion of the upper surface of the keyboard chassis 100.

Black keys 18 are disposed above the center portion of the keyboard chassis 100 as shown by a solid line in FIG. 17 when the console panel 5 is fixed to the rear portion of the keyboard chassis 100 as described above. Pushbutton type self-setting rubber switches 22 provided on the upper surface of the front end portion of a flexible circuit board 123 mounted on the upper surface of the keyboard chassis 100 are located under the switch pressing projections 21 projecting downward from the center on the lower surface of the black keys 18 in the above described state. The rear end portion of the flexible circuit board 123 is extended to a position under the console panel 5, and composes an electric circuit for the keyboard apparatus.

The black keys 18 are urged upwardly by the elastic resetting forces of the flexible portions 107 and the self-resetting forces of the rubber switches 22, and the maximum upward moving position (initial position) of each black key 18 is determined by bringing an L-shaped hook 125, formed to project downward from the front end portion of one of a pair of side plates 124 and inserted into the through hole 126 of the front end portion of the keyboard chassis 100, into contact with a strip-shaped upper limit stop 127 made of a felt or the like provided near the through hole 126 at the lower surface of the keyboard chassis 100. A strip-shaped lower limit stop 128 made of a felt or the like for restricting the maximum downward moving position of each black key 18 is provided on the upper surface of the keyboard chassis 100 at a position corresponding to the upper stop 127, and the lower ends of the paired sidewalls 124 of each black key 184 in brought into contact with the lower limit stop 128 when each black key 184 is depressed. A plurality of key guides 129 for guiding the vertical movements of the black keys 18 are provided on the front upper surface of the keyboard chassis 100. Each key guide 129 slidably contact the inner surfaces of the paired sidewalls 124 of the corresponding black key 18 when the corresponding black key 18 moves in the vertical direction, so that the black keys 18 are prevented from laterally moving while the black keys 18 moves in the vertical direction.

In the keyboard apparatus, the lower case 102 and the console panel 5 are integrally molded with the keyboard chassis 100 of synthetic resin through flexible portions 103, 105, and the black keys 18 are further integrally molded with the console panel 5 through the flexible portions 107. Therefore, the number of components and the number of assembling steps of the keyboard apparatus are considerably reduced, thereby decreasing in manufacturing and assembling costs. The aligning accuracy between the components, especially the disposing accuracy of the black keys 4, can be improved.

In FIG. 17, white keys are not shown, but the white keys may be integrally molded, similarly to the case of the black keys 18, with the front end portion of the console panel 5 through thin flexible portions. For example, as in the case of fifth embodiment to be described later, separately formed white keys may be attached on the keyboard chassis 100 such that the white keys are disposed in a predetermined array with respect to the black keys 18 in front of the front end portion of the console panel 5. Alternatively, only the white keys may be integrally molded with the front end portion of the console panel 5 through thin flexible portions, and the black key molded separately may be attached at a predetermined position on the keyboard chassis 1.

Figure 18:
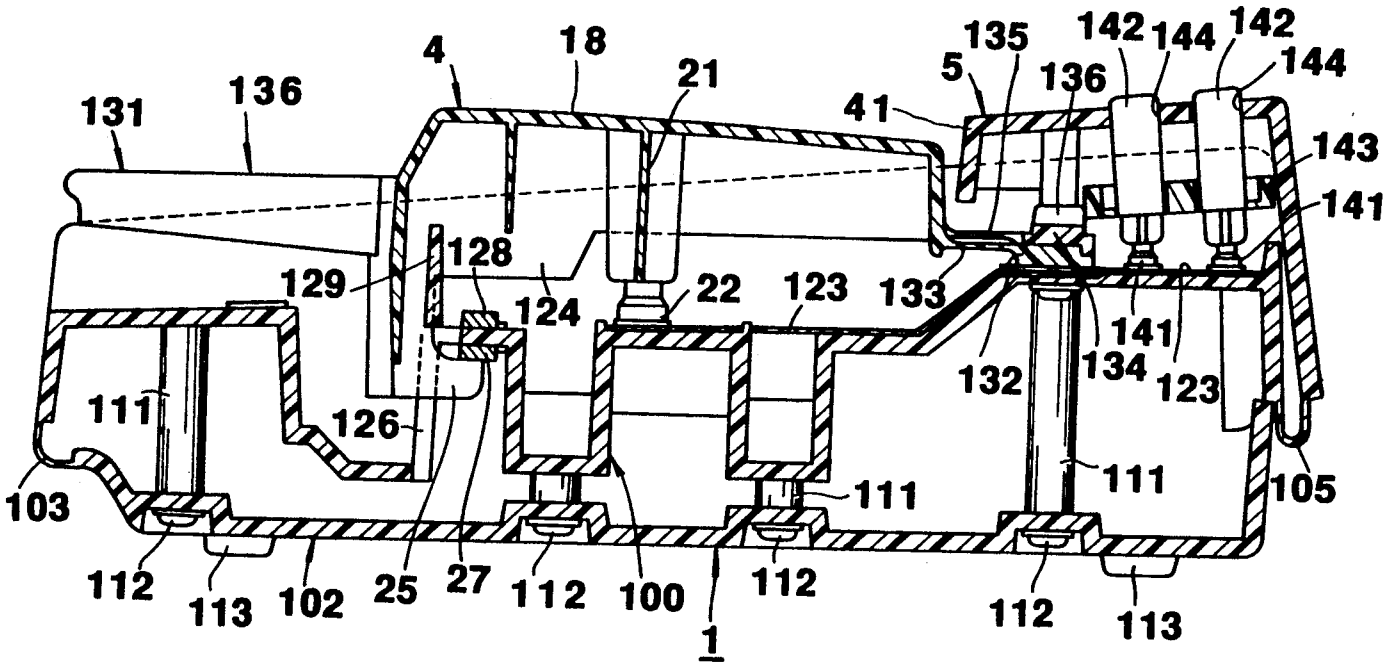
FIG. 18 is a longitudinal sectional view showing a main portion of a keyboard apparatus according to fifth embodiment of the present invention.

FIG. 18 shows a main portion of a keyboard apparatus according to fifth embodiment of the present invention. In FIG. 18, the same reference numerals as those in FIG. 17 ar used for designating like or equivalent components in those of FIG. 17, and the detailed description thereof will be omitted.

In the keyboard apparatus of the fifth embodiment, a keyboard chassis 100, a lower case 102 and a console panel 5 are integrally molded with each other with synthetic resin, and black keys 18 and white keys 131 are formed as separate members. The five black keys 18 for five pitches of, for example C#, D#, F#, G# and A# are integrally molded through thin flexible portions 133 with a common mounting plate 132 having a length corresponding to one octave, and construct one black key group 4. The seven white keys 131 for seven pitches, for example of C, D, E, F, G, A and B are integrally molded through thin flexible portions 135 with a common mounting plate 134 having a length similarly corresponding to one octave, and construct one white key group 136.

The black key group 4 and the white key group 136 described above are installed in a keyboard chassis 100 to form one octave of a keyboard as will be described below. The mounting plate 132 of the black key group 4 is first placed at a predetermined position on the upper surface of the keyboard chassis 100, and the mounting plate 134 of the white key group 136 is superposed on the upper surface of the mounting plate 132 of the black key group 4. In this state, the black keys 18 of the black key group 4 for one octave and the white keys 131 of the white key group 136 for one octave are disposed in predetermined arrays for one octave of a keyboard at the front half portion of the upper surface of the keyboard chassis 100, and screw insertion holes (not shown) formed at the mounting plates 132, 134 coincide with each other. After screws 136 are inserted into the coincided screw insertion holes, the screws 136 are screwed into threaded holes (not shown) formed at the keyboard chassis 100. Then, one black key group 4 and one white key group 136 are attached on the keyboard chassis 100.

After predetermined numbers of black key groups 4 and white key groups 136 are mounted at predetermined positions of the keyboard chassis 100, the console panel 5 is disposed above the rear portion of the keyboard chassis 100 by elastically bending the flexible portion 105, so that the mounting plates 132 and 134 of the black key groups 4 and the white key groups 136 and the flexible portions 133, 135 are covered with the console panel 5. Therefore, the external appearance of the keyboard apparatus can be improved without using the key concealing member formed separately.

In the console panel 5 of the keyboard apparatus, pushbutton switches can be provided as below. A plurality of rubber switches 141 are provided on the upper surface of a flexible circuit board 123 extended under the console panel 5 on the upper surface of the keyboard chassis 100, and a plurality of rod-shaped pushbuttons 142 for pressing the rubber switches 141 are disposed in the guide member 143 provided in the console panel 5 and guide openings 144 formed in the upper wall of the console panel 5. The pushbuttons 142 are prevented form being dropped out from the guide member 143 are guide openings 144. A plurality of pitch designating rubber switches 22 are provided at the front end portion of the flexible circuit board 123 constructing an electronic circuit of the keyboard apparatus, and the abovementioned rubber switches 141 are provided on the rear end portion, thereby omitting an electric connection in the keyboard apparatus and simplifying the number of components of the keyboard apparatus.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A keyboard apparatus comprising:

a musical instrument body;

a plurality of keys detachably attached at base end portions thereof to the musical instrument body; and a console panel attached to said musical instrument body to conceal the base end portions of said keys attached to said musical instrument body;

said console panel having:

one side which is integrally molded with a key concealing portion for concealing the base end portions of said keys which are attached to said musical instrument body; and another side edge which is integrally molded as one piece with said musical instrument body through a flexible portion formed at a peripheral edge of said console which is located at an opposite side to the base end portions of said keys, to permit bending of said console panel relative to said musical instrument body at the position of said flexible portion.

2. The apparatus according to claim 1, wherein said plurality of keys are integrally molded as one piece with each other at the base end portions thereof.

3. The apparatus according to claim 1, wherein a speaker attaching portion on which a speaker is attached is further integrally molded with said console panel.

4. The apparatus according to claim 1, wherein a musical tone card containing portion for containing musical tone cards is further integrally molded with said console panel.

5. The apparatus according to claim 1, wherein a speaker attaching portion on which a speaker is attached and a musical card containing portion for containing musical tone cards are further integrally molded with said console panel.

* * * * *